US009831551B2

(12) United States Patent
Piazza et al.

(10) Patent No.: US 9,831,551 B2
(45) Date of Patent: Nov. 28, 2017

(54) RECONFIGURABLE ANTENNA SYSTEM

(71) Applicant: Adant Technologies, Inc., Santa Clara, CA (US)

(72) Inventors: Daniele Piazza, Padua (IT); Francesco Sacchetto, Padua (IT)

(73) Assignee: Adant Technologies, Inc., Santa Clara, CA (US)

( * ) Notice: Subject to any disclaimer, the term of this patent is extended or adjusted under 35 U.S.C. 154(b) by 143 days.

(21) Appl. No.: 14/409,894

(22) PCT Filed: Jun. 20, 2013

(86) PCT No.: PCT/IB2013/001304
§ 371 (c)(1),
(2) Date: Dec. 19, 2014

(87) PCT Pub. No.: WO2013/190369
PCT Pub. Date: Dec. 27, 2013

(65) Prior Publication Data

US 2015/0333413 A1 Nov. 19, 2015

(30) Foreign Application Priority Data

Jun. 22, 2012 (EP) ..... 12173247

(51) Int. Cl.
*H01Q 3/00* (2006.01)
*H01Q 3/44* (2006.01)
(Continued)

(52) U.S. Cl.
CPC ..... *H01Q 3/44* (2013.01); *H01Q 3/24* (2013.01); *H01Q 9/0457* (2013.01);
(Continued)

(58) Field of Classification Search
CPC ..... H01Q 3/44; H01Q 3/24; H01Q 9/0435; H01Q 9/0442; H01Q 9/0457; H01Q 15/0006; H01Q 19/005; H01Q 21/065
(Continued)

(56) References Cited

U.S. PATENT DOCUMENTS 4,367,474 A 1/1983 Schaubert
6,067,053 A * 5/2000 Runyon ..... H01Q 1/246 343/700 MS (Continued)

FOREIGN PATENT DOCUMENTS

| | | |
|---|---|---|
| EP | 1804335 | 7/2007 |
| JP | 2005159401 | 6/2005 |
| WO | 2011072844 | 6/2011 |

OTHER PUBLICATIONS

European Patent Office: International Search Report, dated Sep. 27, 2013, for International Application No. PCT/IB2013/001304.

*Primary Examiner* — Chuong P Nguyen
(74) *Attorney, Agent, or Firm* — Patterson Intellectual Property Law, P.C.; Mark J. Patterson; Gary L. Montle

(57) ABSTRACT

The invention relates to a reconfigurable antenna system (1), which comprises a plurality of antenna units (10) and does not employ phase shifters. Each antenna unit (10) is by itself a reconfigurable antenna having at least an active radiating element which is coupled to one or more passive radiating elements. Each antenna unit is provided with one or more variable loads (12) that can be electrically connected/disconnected to each other and with said antenna unit (10), to selectively configure the radiating properties of the system. A bias network (70) is adopted to bias the variable loads (12) and a control unit (80) allows controlling the operation of said bias network (70). Each active radiating element is fed by at least a feeding line (501) that provides it with a suitable polarization. Hence, the system can advantageously resort to
(Continued)

multiple polarizations, each of them being provided by a same source. Preferably, each active radiating element receive its feeding signal from the source/s by means of power dividers (60) and/or switches. Preferably, each antenna unit is covered by at least a radiating structure, comprising a plurality of passive radiating elements, which does not affect the reconfigurability of the antenna unit itself and increases the overall antenna gain. The antenna system is then characterized by remarkable beam-steering capabilities and high gain, avoiding the losses and complexities related to phase shifters and overcoming the typically small antenna gain values of current reconfigurable antenna systems.

4 Claims, 10 Drawing Sheets

(51) Int. Cl.

| | |
|---|---|
| ***H01Q 3/24*** | (2006.01) |
| *H01Q 9/04* | (2006.01) |
| *H01Q 15/00* | (2006.01) |
| *H01Q 19/00* | (2006.01) |
| *H01Q 21/06* | (2006.01) |

(52) U.S. Cl.
CPC ..... *H01Q 9/0435* (2013.01); *H01Q 9/0442* (2013.01); *H01Q 15/0006* (2013.01); *H01Q 19/005* (2013.01); *H01Q 21/065* (2013.01)

(58) Field of Classification Search
USPC ..... 342/374; 343/876, 700 R
See application file for complete search history.

(56) References Cited

U.S. PATENT DOCUMENTS

| | | | | |
|---|---|---|---|---|
| 6,545,647 | B1 * | 4/2003 | Sievenpiper | H01Q 21/245 343/756 |
| 7,057,573 | B2 * | 6/2006 | Ohira | H01Q 3/22 343/817 |
| 7,068,234 | B2 * | 6/2006 | Sievenpiper | H01Q 3/26 343/745 |
| 7,764,232 | B2 * | 7/2010 | Achour | H01Q 21/065 343/700 MS |
| 8,345,716 | B1 * | 1/2013 | Ehret | H04B 7/10 370/334 |
| 8,421,684 | B2 * | 4/2013 | Livneh | H01Q 3/26 343/702 |
| 8,629,807 | B2 * | 1/2014 | Wood | G01S 7/03 342/372 |
| 8,967,485 | B2 * | 3/2015 | Piazza | H01Q 3/00 235/487 |
| 2003/0043071 | A1 * | 3/2003 | Lilly | H01Q 3/22 342/368 |
| 2005/0200528 | A1 | 9/2005 | Carrender | |
| 2008/0088510 | A1 * | 4/2008 | Murata | H01Q 3/24 343/700 MS |
| 2008/0102760 | A1 * | 5/2008 | McConnell | H04B 7/0617 455/73 |
| 2011/0080325 | A1 | 4/2011 | Livneh | |
| 2015/0022412 | A1 * | 1/2015 | Facco | H01Q 3/00 343/833 |

* cited by examiner

RECONFIGURABLE ANTENNA SYSTEM

The present invention relates to the technical field of the reconfigurable antenna systems.

As is known, most traditional antenna systems comprise one or more antennas, which radiate electromagnetic waves according to a fixed radiation pattern and polarization.

Adaptive antenna systems are known, which are capable of varying their radiation diagram, according to the needs.

These antenna systems typically comprise phased array antenna systems, switching antenna systems and reconfigurable antenna systems.

A phased array antenna system generally consists of a matrix of active antenna elements that are fed with a controllable phase, so that it can radiate electromagnetic waves according to a radiation pattern and a polarization that may be suitably controlled.

A phased array antenna system adopts multiple antenna elements to enhance the gain and multiple phase shifters to properly steer the overall radiation beam.

A phased array antenna system is generally quite effective in steering the radiation lobes with high directivity.

Unfortunately, industrial production costs are sometimes prohibitive for certain applications and the radiation efficiency is generally low due the relatively high losses of the phase shifters.

A switching antenna system typically employs multiple high gain antennas pointing towards different directions and a network of switches that allow selecting the highest gain antenna pointing towards a certain direction.

Even if it is very effective in achieving high antenna gain values, a switching antenna system has some important drawbacks.

The antenna form factor is generally very large and it is therefore sometimes not acceptable for certain applications.

Further, industrial production costs are often quite relevant.

A reconfigurable antenna system generally comprises antennas showing a different pattern and polarization, depending on the adopted current distribution on the radiating element of each antenna unit.

Adaptive antenna systems have received strong attention in the last years thanks to their capability of dynamically changing their radiation properties in response to the behavior of the wireless channel.

It is acknowledged that reconfigurable antenna systems offer some advantages with respect to other adaptive antenna systems, since they employ single active elements.

Generally, they have a smaller size and allow achieving higher radiation efficiency.

A relevant drawback of current reconfigurable antenna systems consists in that they can reconfigure their radiation pattern and/or polarization with a relatively small antenna gain values.

Therefore, in the market it is still felt the need for reconfigurable antenna systems that show relatively high beam-steering capabilities, high antenna gain values, small form factor and low industrial costs.

In order to respond to this need, the present invention provides a reconfigurable antenna system, according to the following claims.

Further characteristics and advantages of the present invention shall emerge more clearly from the description of preferred but not exclusive embodiments that are illustrated purely by way of example and without limitation in the attached drawings 1-10.

Figure 1:
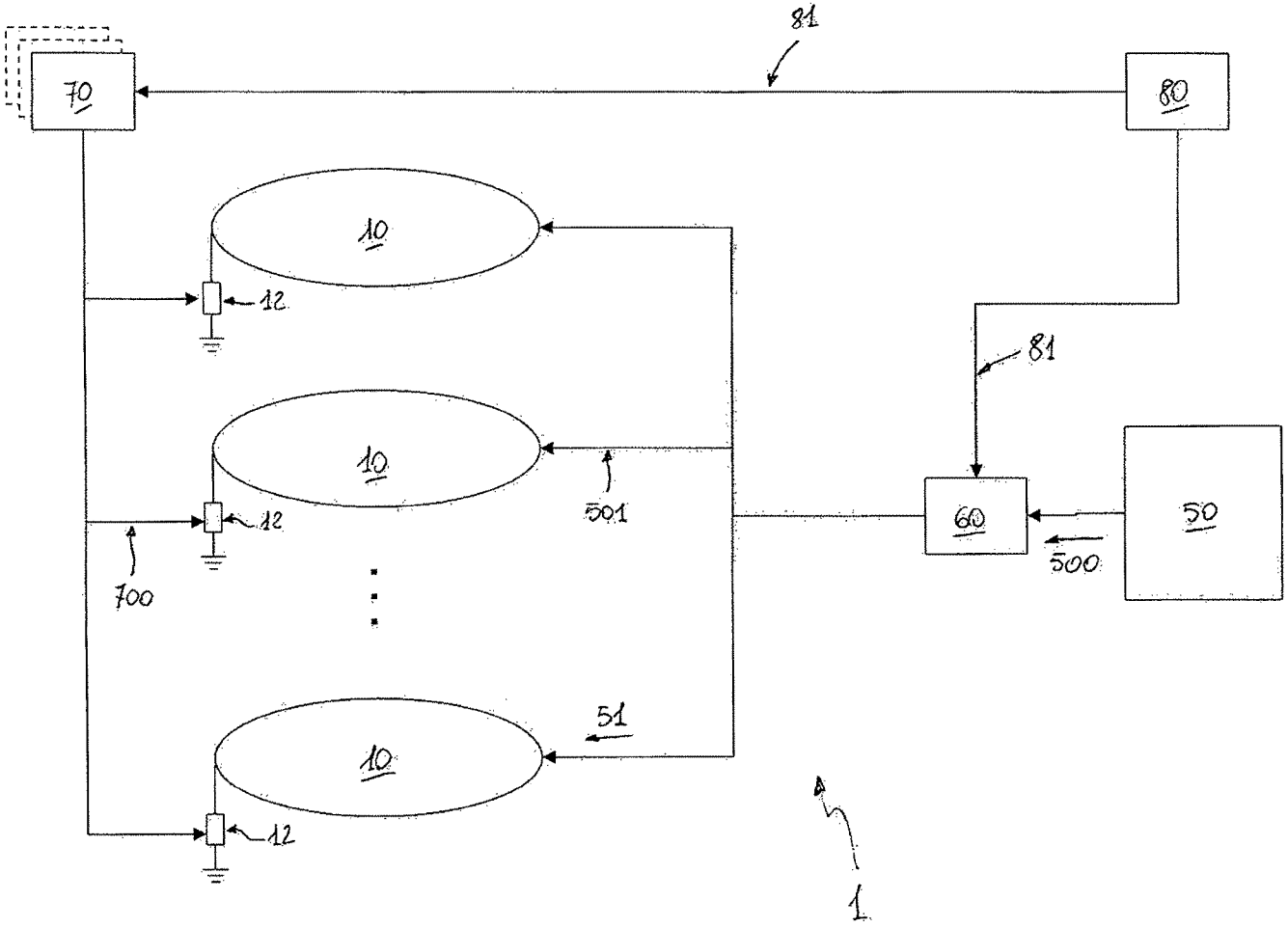
FIG. 1 is a block diagram representing an exemplary embodiment of a reconfigurable antenna system as disclosed herein.

With reference to the mentioned figures, the present invention relates to a reconfigurable antenna system 1.

The antenna system 1 comprises a plurality of antenna units 10 that may be arranged according to different topologies, e.g. in parallel or according to a star configuration.

Each antenna unit 10 comprises at least an active radiating element 11 that is capable of radiating electromagnetic waves W.

For the purposes of the present invention, a radiating element is defined as an "active radiating element" in case such a radiating element is fed by one or more feeding lines that provide it with a suitable feeding signal.

The active radiating element 11 is advantageously fed by at least a feeding line 501 that provides the feeding signal 51 (typically a current signal).

Each antenna unit 10 is electrically connectable with one or more variable loads 12.

The loads 12 may be circuit elements having variable impedance. They may be circuit elements having a variable or fixed impedance that are electrically connected/disconnected each other and with the corresponding antenna unit 10, for example shorted to ground or left open, according to the needs.

According to possible embodiments of the present invention, the variable loads 12 may comprise one or more meta-material (CRLH) cells.

According to further embodiments, the variable loads 12 may comprise variable capacitors (varactors) that are arranged to vary the overall reactance of the corresponding antenna unit 10, according to the needs.

Said variable capacitors may be advantageously coupled to a passive network of lumped elements, such as SMD capacitors and inductors and/or microstrip inductors and interdigital capacitors.

Thanks to the variable loads 12, each antenna unit 10 is capable of varying the direction and/or polarization of the emitted electromagnetic radiation W.

Each antenna unit 10 is thus a reconfigurable antenna by itself.

The antenna system 1 can thus advantageously be formed by an array or matrix of antenna units 10.

According to the invention, the reconfigurable antenna system 1 comprises a same single source 50 (preferably a RF source) for providing all the active radiating elements of the antenna units 10 with the feeding signals 51.

The source 50 may be any device suitable to provide the feeding signals 51 to the active radiating elements 11, so as to cause the radiation of electromagnetic waves W with a given polarization by said active radiating elements.

As it will be more apparent from some embodiments described in the following, different sources 50, which operate independently one from another, may be employed in case feeding signals, which cause the active radiating elements to radiate electromagnetic waves W with different polarizations, are provided.

However, the active radiating elements 11 of the antenna system 1 are always fed by a same common source 50 for each given polarization of the electromagnetic waves W to be radiated. The feeding signals 51 may have carrying frequencies between 300 MHz and 30 GHz. Preferably the feeding signals 51 have radio-frequency (RF) carrying frequencies Advantageously, the feeding signals 51 are not phased one another. In this way, no phase shifters are required with a consequent simplification of the overall circuital structure of the antenna system 1.

Further, since the antenna units 10 are electrically connected to a same source 50 for at least a given polarization of the electromagnetic waves W to be radiated, the antenna system 1 differs from solutions, where each active radiating element is typically connected to a separate branch of a transmitter/receiver.

Preferably, the antenna system 1 comprises one or more power dividers 60 (e.g. suitable circuit arrangements or switches) that receive a single feeding signal 500 from the source 50 and provide the feeding signals 51.

The antenna system 1 comprises at least a bias network 70 (typically a DC network) for biasing the variable loads 12.

The bias network 70 provides the variable loads 12 with biasing signals 700, so as to obtain a certain current distribution along each antenna unit 10.

This allows properly configuring the radiation lobes of each antenna unit 10. The radiated electromagnetic waves W can thus be easily directed along desired directions.

According to some embodiments of the invention, the antenna system 1 comprises a same single bias network 70 for biasing the variable loads 12 of two or more antenna units 10, (advantageously of each antenna unit 10).

In this case, the bias network 70 is shared between the antenna units 10. The same biasing signals 700 are thus applied simultaneously to the antenna units 10. These latter can therefore be easily configured to direct the electromagnetic radiation W towards a same direction, so as to increase the overall gain along said direction.

Figure 6:
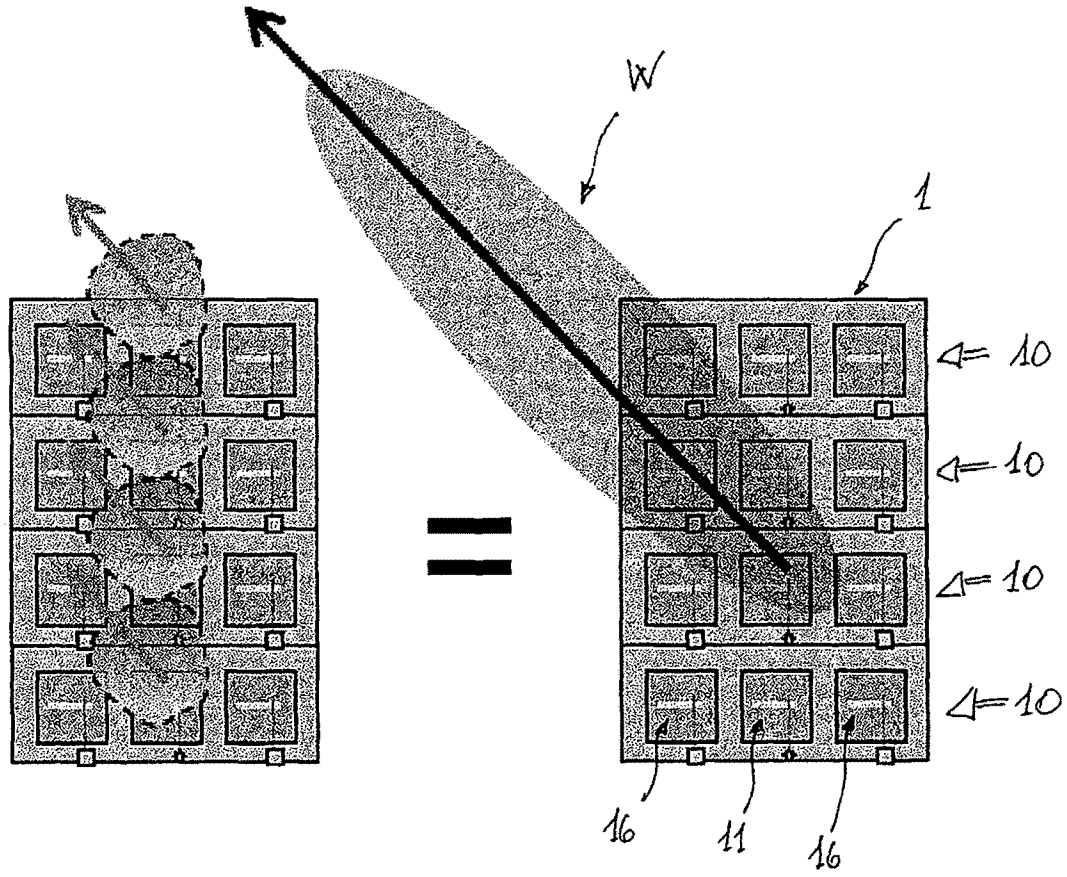
FIG. 6 is a diagram representing an exemplary embodiment wherein a group of antenna units are configured to direct an electromagnetic radiation toward a same direction.

In this way, an increased overall radiation beam is generated thanks to the superposition of the beams generated by each antenna unit 10 (FIG. 6).

According to this solution, the bias network 70 may be remarkably simplified, thereby being of relatively easy and cheap implementation.

According to other embodiments of the invention, the antenna system 1 comprises a plurality of bias networks 70, each of which is arranged to bias the variable loads 12 of a corresponding antenna unit 10.

In this case, each bias network 70 works independently from the others and it allows the corresponding antenna unit 10 to radiate electromagnetic waves W towards a different direction, if needed.

By independently controlling the radiation properties of each antenna unit 10, it is possible to compensate possible radiation imbalances caused by phase lags or delays that may be introduced by the power dividers 60.

Preferably, the antenna system 1 comprises a control unit 80 (e.g. a digital processing device) that provides control signals 81 for controlling the operation of the bias network 70 and, possibly, of the power dividers 60.

According to some embodiments of the present invention, one or more antenna units 10 (preferably each antenna unit 10) comprise one or more first passive radiating elements 16.

For the purposes of the present invention, a radiating element is defined as a "passive radiating element" in case such a radiating element is not fed by any feeding line connected to a source 50.

The first passive radiating elements 16 are positioned in the proximity of the active element 11, so as to be electromagnetically coupled with this latter, when said active radiating element 11 radiates electromagnetic waves.

In order to ensure a good electromagnetic coupling, the maximum distance between the radiating elements 11 and 16 must be lower than the carrying wavelength λ.

The passive radiating elements 16 are thus excited by the proximity coupling with the active radiating element 11 and are therefore capable of radiating electromagnetic waves W.

The number of the passive radiating elements 16 may vary according to the needs. Basically, the larger is the number of passive radiating elements, the wider is the angle that can be scanned by each antenna unit 10.

Figure 2:
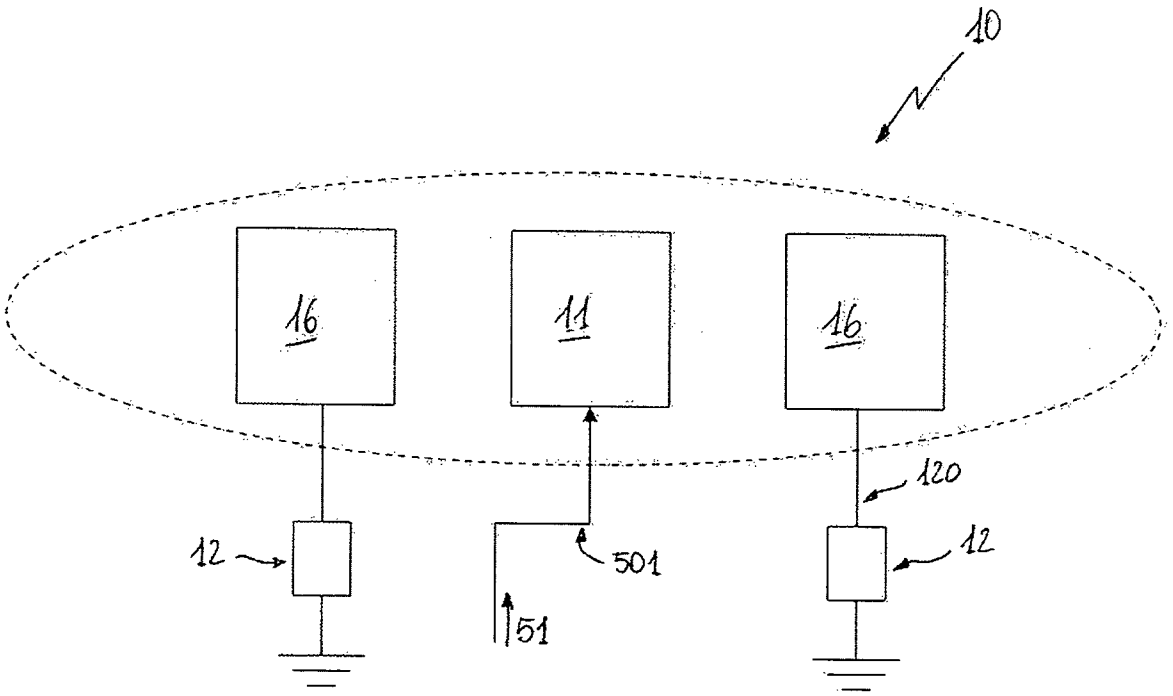
FIG. 2 is a block diagram representing an exemplary embodiment of an antenna unit in a reconfigurable antenna system as disclosed herein.
Figure 3:
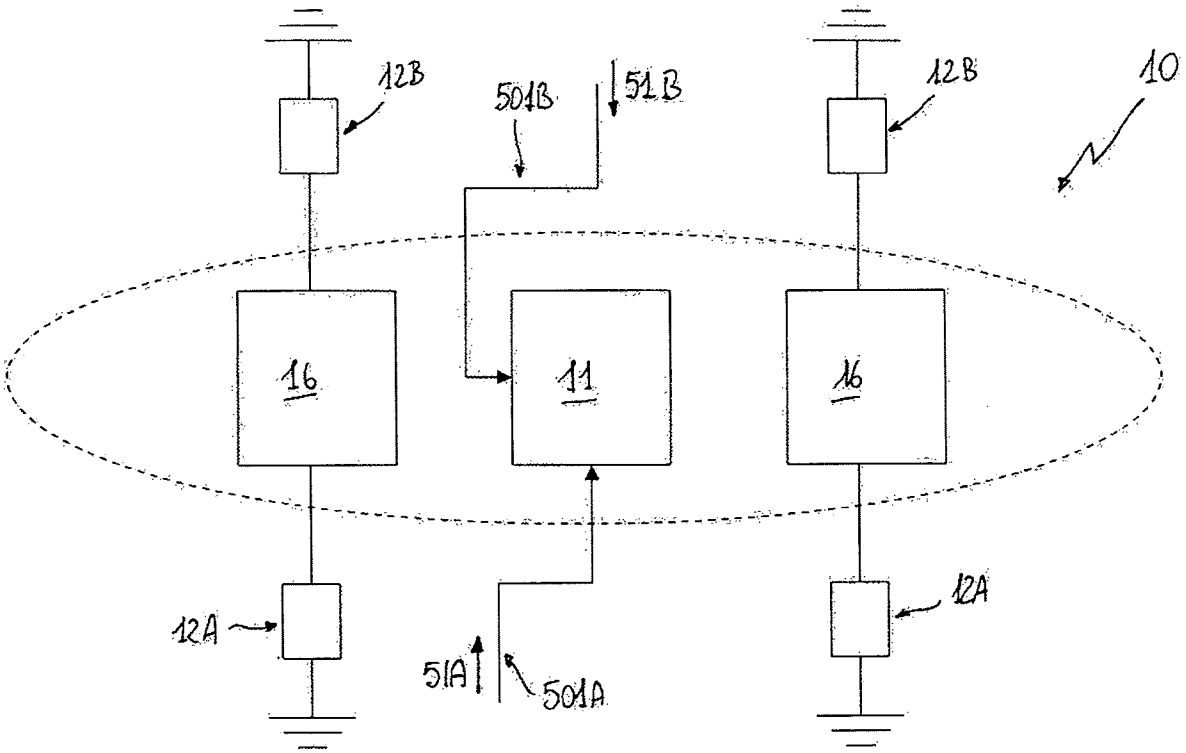
FIG. 3 is a block diagram representing another exemplary embodiment of an antenna unit in a reconfigurable antenna system as disclosed herein.
Figure 7:
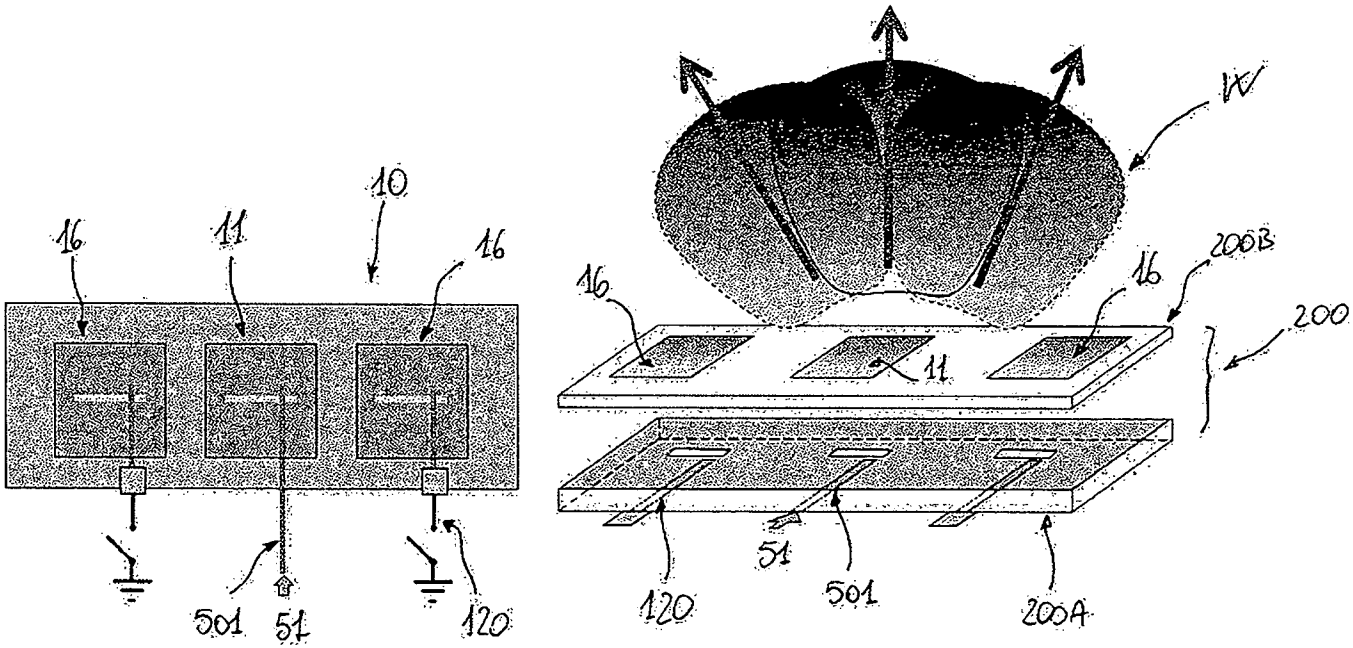
FIG. 7 is a diagram representing another exemplary embodiment of an antenna unit in a reconfigurable antenna system as disclosed herein, wherein an associated active radiating element (patch) is slot-fed.

In the embodiments shown in FIGS. 2-3, 7 each antenna unit 10 comprises a single active radiating element 11 that is sided by two passive radiating elements 16.

Of course, other arrangements are possible, according to the needs.

Preferably, the variable loads 12 of each antenna unit 10 are electrically connectable to the passive radiating elements 16.

Thanks to the bias network 70, the variable loads 12 can vary their impedance and/or be electrically connected/disconnected each other and with each of the passive radiating elements 16.

The bias signals 700 provided by the bias network 70 thus allow varying the current distribution both in the active and passive radiating elements 11, 16, thereby allowing properly configuring the radiation pattern of the antenna unit 10.

According to other embodiments of the present invention, one or more antenna units 10 comprise a plurality of feeding lines 501A, 501B for feeding the active radiating element 11 with a plurality of feeding signals 51A, 51B, so that said active radiating element radiates electromagnetic waves W having a plurality of predefined polarizations.

In an embodiment (FIGS. 3, 8), one or more antenna units 10 (preferably each antenna unit 10) comprise a first feeding line 501A and a second feeding line 501B for feeding the active radiating element 11.

The first feeding line 501A feeds the active radiating element 11 with a first feeding signal 51A, so that the active radiating element 11 radiates electromagnetic waves W having a first predefined polarization.

On the other hand, the second feeding line 501B feeds the active radiating element 11 with a second feeding signal 51B, so that the active radiating element 11 radiates electromagnetic waves W having a second predefined polarization.

The feeding line 501A and 501B may receive the feeding signals 51A, 51B from two independent sources 50 or from a same single source 50 that can be switched between the mentioned feeding lines.

Each antenna unit 10 can thus be provided with independent feeding lines 501A, 501B to cause the active radiating element 11 to radiate electromagnetic waves W with different polarizations, e.g. a horizontal and a vertical polarization.

Since the polarizations are different, the radiated electromagnetic waves W do not mutually interfere.

Preferably, the antenna system 1 is advantageously provided with a first feeding tree 501A that is coupled to a first source providing the first feeding signals 51A and with a second feeding tree 501B that is coupled to a second source providing the second feeding signals 51B.

It has to be evidenced that, also in this embodiment, the antenna units 10 are always fed by a same source for at least a given polarization of the electromagnetic waves W to be radiated, in accordance to the invention.

Thanks to this solution, the antenna system 1 works as two independent reconfigurable antenna systems transmitting with different polarizations.

Of course, according to other embodiments, the antenna units 10 may comprise a larger number (more than two) of feeding lines that may be fed by a corresponding number of sources 50 or by a single source 50 switching between said feeding lines.

Also in this case, it is evidenced that a same single common source 50 is arranged to provide feeding signals to cause the radiating elements to radiate electromagnetic waves W with at least a given polarization.

Preferably, the antenna system 1 comprises advantageously one or more first and second variable loads 12A, 12B.

As the variable loads 12, the loads 12A, 12B may be circuit elements having variable impedance. They may be circuit elements having a variable or fixed impedance and that are electrically connected/disconnected each other and with the corresponding antenna unit 10, for example shorted to ground or left open, according to the needs.

Also the variable loads 12A, 12B may comprise one or more meta-material (CRLH) cells and/or variable capacitors (varactors) and/or be coupled to a passive network of lumped elements.

The variable loads 12A are operatively associated to the antenna unit 10 to selectively configure the radiating properties of said antenna unit, when this latter radiates electromagnetic waves according to a first polarization.

Similarly, the variable loads 12B are operatively associated to each antenna unit 10 to selectively configure the radiating properties of said antenna unit, when this latter radiates electromagnetic waves according to a second polarization.

Figure 4:
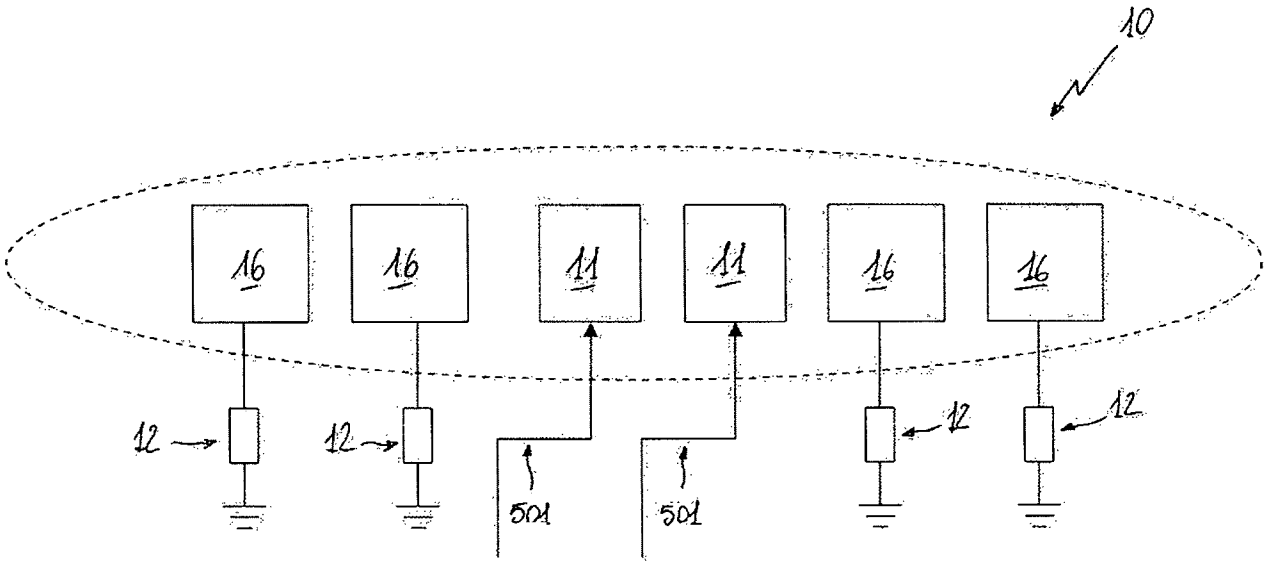
FIG. 4 is a block diagram representing another exemplary embodiment of an antenna unit in a reconfigurable antenna system as disclosed herein.

According to some embodiments of the present invention (FIGS. 4-5), one or more antenna units 10 (preferably each antenna unit 10) comprise a plurality of active radiating elements 11, each of them being fed by at least a feeding line 501.

Also in this case, each antenna unit 10 may comprise one or more passive radiating elements 16 that are electromagnetically coupled with the active radiating elements 11.

As described above, the passive radiating elements 16 are positioned in the proximity of the active radiating elements 11, so as to be electromagnetically coupled with said active radiating elements, when these latter radiate electromagnetic waves W.

Also in this case, the number of the passive radiating elements 16 may vary according to the needs.

Preferably, the variable loads 12 of each antenna unit 10 are electrically connectable to the passive radiating elements 16.

Figure 5:
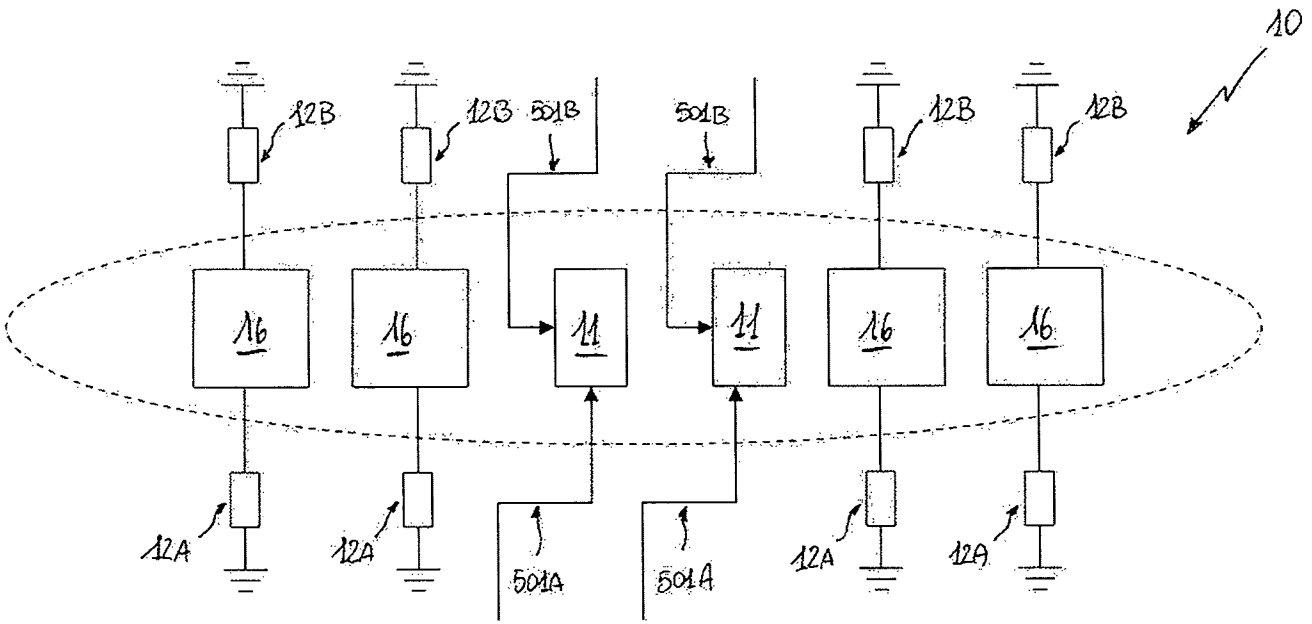
FIG. 5 is a block diagram representing another exemplary embodiment of an antenna unit in a reconfigurable antenna system as disclosed herein.

In the embodiment shown in FIG. 5, each of the active radiating elements 11 is fed by two independent feeding lines 501A, 501B, according to the dual polarization scheme described above.

Similarly, first and second variable loads 12A, 12B are connectable to the passive elements 16.

The antenna system 1 may be realized in practice according to various technologies.

Preferably, a printed circuit technology is advantageously adopted for realizing the antenna units 10.

The radiating elements 11, 16 can be formed by conductive patches arranged on an insulating layer.

Similarly, the feeding lines 501 may be formed, at least partially, by conductive microstrips or vias arranged on an insulating layer.

In the example of FIG. 7, the active radiating element (patch) 11 is slot-fed, which means that a cut is made in the ground plane of the feeding microstrip 501.

Such a cut allows the energy provided by the feeding signal 51 to pass through the ground plane and to couple to said radiating element.

In a similar way, the passive radiating elements (patches) 16 are slot-coupled to a truncated microstrip line 120 connected to the variable loads 12.

Preferably, the antenna units 10 comprises each a planar substrate 200 that may advantageously comprise a feeding layer 200A, where the feeding lines 51, 120 are arranged, and a radiating layer 200B, when the radiating elements (patches) 11, 16 are arranged.

According to some embodiments of the present invention, the substrate 200 is covered by at least an upper radiating structure 300, advantageously planar, that comprises a plurality of second passive radiating elements 301.

The second passive radiating elements 301 are positioned so as to be electromagnetically coupled with the radiating elements 11, 16, when these latter radiate electromagnetic waves W.

To this aim, the maximum distance between the radiating elements 301 and the radiating elements 11, 16 must be lower than the carrying wavelength λ.

The radiating structure 300 may be a single layer or multi-layer structure.

The passive radiating elements 301 may be conductive patches formed on a dielectric substrate or slots/holes formed in a metal sheet.

The passive radiating elements 301 may be formed by meta-material cells.

In this case, each radiating element 301 may be advantageously designed to present non-conventional electromagnetic properties that allow concentrating the electromagnetic waves W coming from the radiating elements 11, 16 towards the radiation direction, with which said electromagnetic waves have been emitted. In this way, the directivity of the antenna system 1 can be remarkably enhanced, thereby increasing the overall antenna gain.

Figure 9:
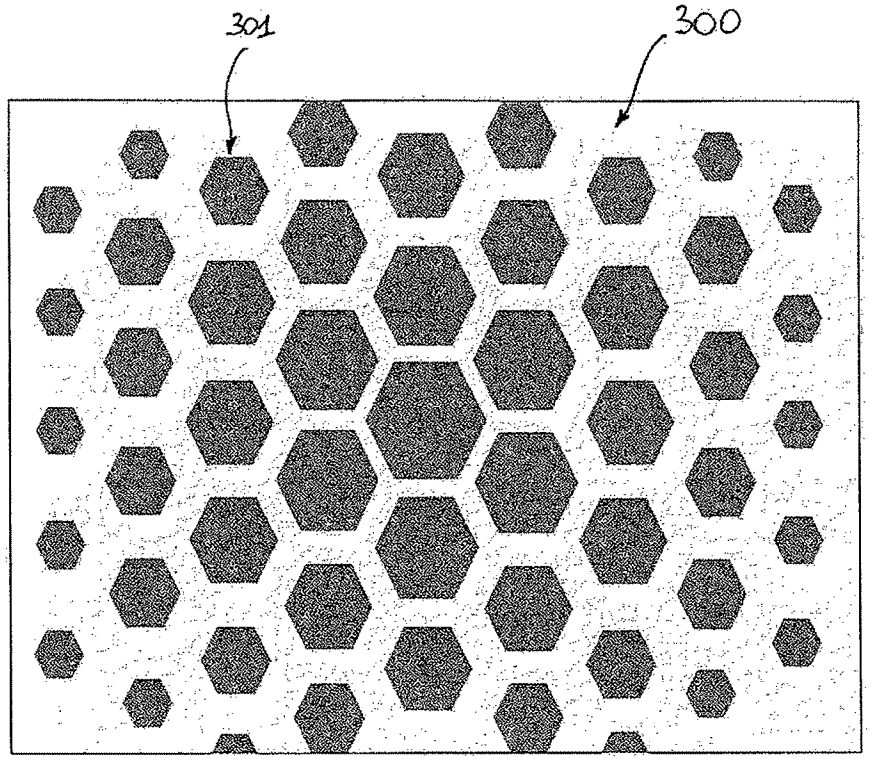
FIG. 9 is a diagram representing an exemplary arrangement for a radiating structure having a plurality of passive radiating elements.

Preferably, the second passive radiating elements 301 have a different geometrical shape and/or distribution, depending on their position in the radiating structure 300 (FIG. 9).

This solution allows remarkably increasing the antenna gain without changing the direction of radiation determined by the radiating elements 11, 16.

Therefore, the radiating structure 300 does not affect the reconfigurability of the radiating lobes of each antenna unit 10 and it allows achieving relatively high gain values for different directions of radiation, according to the needs.

Figure 8:
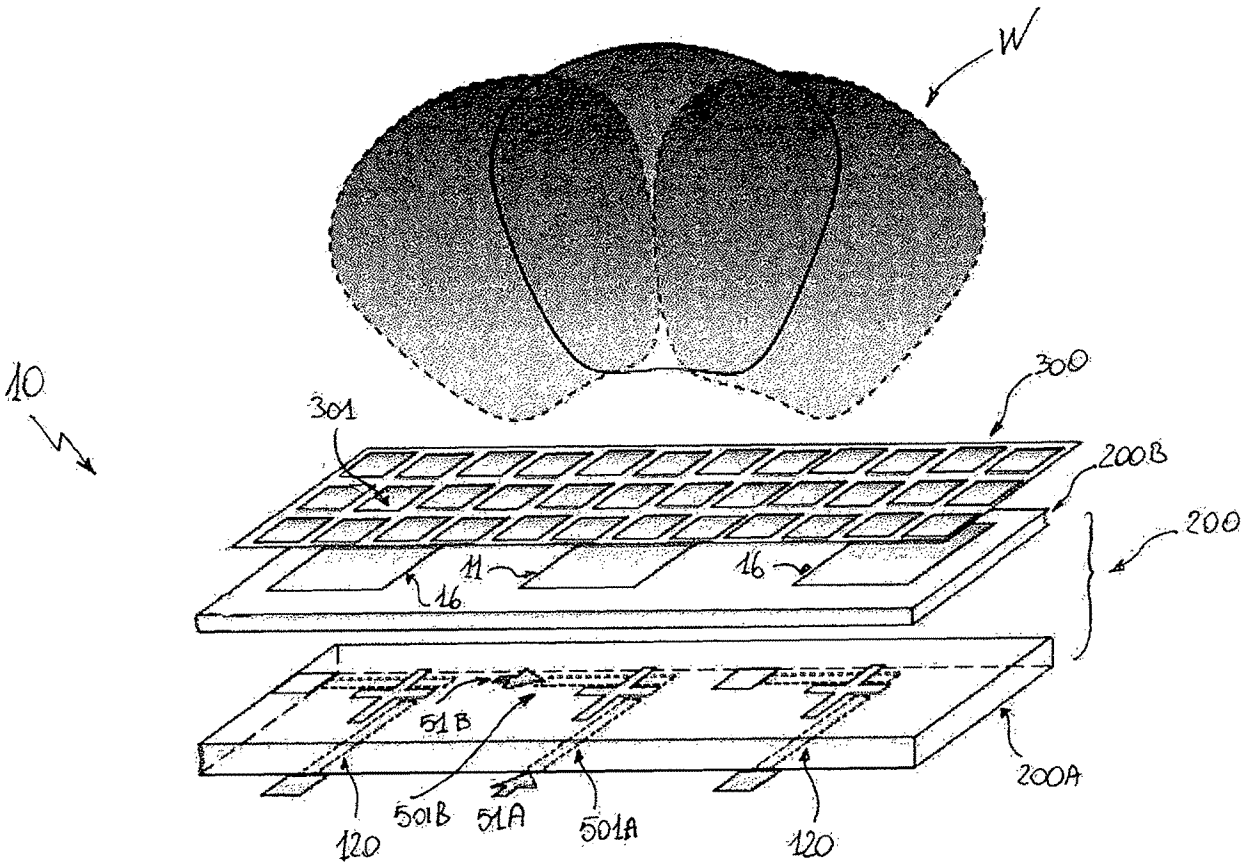
FIG. 8 is a diagram representing another exemplary embodiment of an antenna unit in a reconfigurable antenna system as disclosed herein, wherein each antenna unit is covered by a different radiating structure.

In the embodiment shown in FIG. 8, each antenna unit 10 is covered by a different dedicated radiating structure 300.

As an alternative, a single radiating structure 300 is used to cover all the antenna units 10.

In a further aspect, the present invention relates to an antenna system 100 that comprises one or more reconfigurable antennas 101.

In principle, the reconfigurable antennas 101 may be of any type.

Preferably, at least one of the antennas 101 comprises one or more antenna units 10.

The radiating antennas 101 are operatively associated to at least a radiating structure 103, which comprises a plurality of radiating elements 104.

Figure 10:
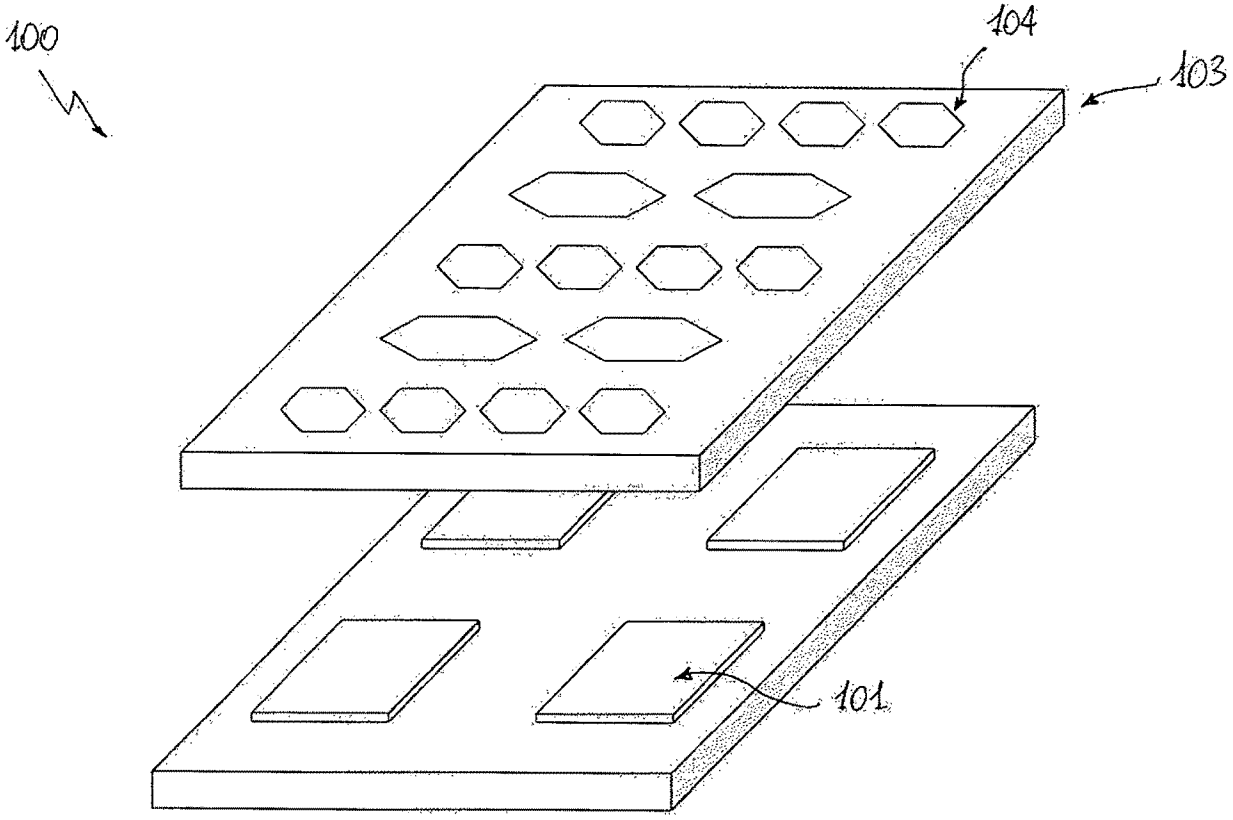
FIG. 10 is a diagram representing an exemplary arrangement for a radiating structure having a plurality of radiating elements, and operatively associated to radiating antennas.

The radiating structure 103 may be a planar structure, as shown in FIG. 10, and it may be a single layer or a multi-layer structure.

In principle, however, the radiating structure 103 may have any shape or dimension, according to the needs. For example, it may be a suitably shaped 3D radiating structure.

The radiating elements 104 are positioned so as to be electromagnetically coupled with the antennas 101, when these latter radiate electromagnetic waves W.

To this aim, the maximum distance between the radiating elements 104 and the antennas 101 must be lower than the carrying wavelength $\lambda$ of said antennas.

The radiating elements 104 may be conductive patches formed on a dielectric substrate or a slots/holes formed in a metal sheet.

The radiating elements 104 may be formed by metamaterial cells.

In this case, each radiating element 104 may be advantageously designed to present non-conventional electromagnetic properties.

The radiating structure 103 allows concentrating the electromagnetic waves W coming from the antennas 101 towards the radiation direction, with which said electromagnetic waves have been emitted.

In this way, the directivity of the whole antenna system 100 can be remarkably enhanced, thereby increasing the overall antenna gain.

The radiating elements 104 may have a different geometrical shape and/or distribution, depending on their position in the radiating structure 103 (FIG. 10).

This solution allows remarkably increasing the antenna gain without changing the direction of radiation that is determined by the antennas 101.

Therefore, the radiating structure 103 does not affect the reconfigurability of the radiating lobes of the antennas 101 and it allows achieving relatively high gain values for different directions of radiation, according to the needs.

In the embodiment shown in FIG. 10, a single radiating structure 103 is used to cover all the antennas 101.

As an alternative, each antenna 101 or groups of antennas 101 may be covered by a different dedicated radiating structure 103.

The antenna system, according to the invention, allows the achieving of relevant advantages.

The antenna system, according to the invention, allows scanning the surrounding space according to continuously different directions with a high gain.

When an isolated receiver is located at a certain position, the antenna system is capable of focusing the radiated energy towards that direction, without wasting power in the surrounding space.

On the other hand, when multiple users are located within a certain space sector, the antenna system is capable of configuring its radiation lobes so as to continuously scan said space sector. In this case, the antenna system is capable of behaving as a static sector antenna, without coverage reductions at the edges of the space sector. The continuous scanning activity with high gain reconfigurable lobes, in fact, allows a more uniform coverage. The achievable high gain values further allow covering wider space sectors.

From the above, it is apparent how the antenna system, according to the invention, is characterised by remarkable beam-steering capabilities, relatively high gain values and a relatively small form factor.

The antenna system, according to the invention, has proven to be of relatively easy and cheap realization at industrial level and practical installation on the field.

The invention claimed is:

1. A reconfigurable antenna system comprising:

a plurality of antenna units each comprising a planar substrate having a first layer with one or more active radiating units arranged thereon and capable of radiating electromagnetic waves, and a second layer;

one or more variable loads that are operatively associated to each of said antenna units and that can be electrically connected to/disconnected from each other and the corresponding antenna unit, to selectively configure the radiating properties of said antenna unit;

at least a bias network configured to provide biasing signals to the variable loads that are operatively associated to said antenna units, for varying the current distribution along each antenna unit and thereby allowing properly configuring the radiation pattern of the antenna unit;

a single source electrically coupled to each of the plurality of antenna units via feeding lines arranged in the second layer, and configured to provide feeding signals to the active radiating elements of said antenna units to cause said active radiating elements to radiate electromagnetic waves with at least a given polarization; and a radiating structure comprising at least a planar third layer having a plurality of passive radiating elements positioned thereon, and electromagnetically coupled with one or more of antenna units when they radiate electromagnetic waves, wherein the first layer is disposed between the second layer and the third layer.

2. The reconfigurable antenna system of claim 1, wherein each of the plurality of antenna units is covered by a different radiating structure.

3. The reconfigurable antenna system of claim 1, wherein a single radiating structure covers each of the plurality of antenna units.

4. The reconfigurable antenna system of claim 1, further comprising:

one or more power dividers configured to receive a single feeding signal from said source and provide said feeding signals to the active radiating units of said antenna units;

a plurality of bias networks, each of said bias network being arranged to bias the variable loads of a corresponding antenna unit; and a control unit configured to provide control signals for controlling the operation of said power dividers, and to provide control signals for independently controlling the operation of each bias network, to compensate for radiation imbalances introduced by said power dividers.

* * * * *